US006752047B1

(12) United States Patent
Lee

(10) Patent No.: US 6,752,047 B1
(45) Date of Patent: Jun. 22, 2004

(54) RATCHET WRENCH WITH ADJUSTABLE WORKING SIZE

(76) Inventor: Yi Min Lee, No. 62, Renmei Rd., Dali City, Taichung (TW), 401

( * ) Notice: Subject to any disclaimer, the term of this patent is extended or adjusted under 35 U.S.C. 154(b) by 0 days.

(21) Appl. No.: 10/419,834

(22) Filed: Apr. 22, 2003

(51) Int. Cl.[7] ..... B25B 13/46; B25B 13/10

(52) U.S. Cl. ..... 81/60; 81/129.5; 81/155; 81/176.3

(58) Field of Search ..... 81/60, 128, 129, 81/129.5, 155, 157, 164, 175, 176.3

(56) References Cited

U.S. PATENT DOCUMENTS 133,402 A * 11/1872 Bonneville ..... 81/61
594,023 A * 11/1897 Krueger ..... 81/62
743,096 A * 11/1903 Pelle ..... 81/63
1,060,874 A * 5/1913 Winkle ..... 81/128
1,074,594 A * 10/1913 Andersen ..... 81/62
1,450,641 A * 4/1923 Ograbisz ..... 81/63.2
2,073,314 A * 3/1937 Mihalyi ..... 359/892
3,385,142 A * 5/1968 Cunningham ..... 81/129.5

* cited by examiner

*Primary Examiner*—Joseph J. Hail, III
*Assistant Examiner*—David B. Thomas
(74) *Attorney, Agent, or Firm*—Rosenberg, Klein & Lee

(57) ABSTRACT

A ratchet wrench includes a handle, a ratchet wheel, a plurality of adjusting blocks, and an adjusting shaft. The adjusting shaft is rotatably mounted in the working space of the ratchet wheel and has a toothed disk meshing with the outer thread of each of the adjusting blocks, so that each of the adjusting blocks is rotated by rotation of the adjusting shaft to move into the working space of the ratchet wheel so as to adjust the working size of the working space of the ratchet wheel. Thus, the ratchet wrench can be used to operate workpieces of different sizes and specifications.

10 Claims, 6 Drawing Sheets

RATCHET WRENCH WITH ADJUSTABLE WORKING SIZE

BACKGROUND OF THE INVENTION

1. Field of the Invention

The present invention relates to a ratchet wrench, and more particularly to a ratchet wrench with an adjustable working size, wherein the ratchet wrench can be used to operate workpieces of different sizes and specifications.

2. Description of the Related Art

A conventional ratchet wrench comprises a handle having an end formed with a receiving hole, and a ratchet wheel mounted in the receiving hole of the handle and having inside formed with a polygonal recess. In such a manner, the workpiece (such as the bolt, nut or the like) is received the recess of the ratchet wheel, so that the workpiece can be rotated by rotation of the handle. However, the conventional ratchet wrench cannot be used to operate and rotate workpieces of different sizes and specifications, so that the user needs to prepare ratchet wrenches of different sizes and specifications so as to operate workpieces of different sizes and specifications, thereby greatly causing inconvenience to the user.

SUMMARY OF THE INVENTION

The present invention is to mitigate and/or obviate the disadvantage of the conventional ratchet wrench.

The primary objective of the present invention is to provide a ratchet wrench that can be used to operate workpieces of different sizes and specifications.

Another objective of the present invention is to provide a ratchet wrench, wherein the user only needs to use a single ratchet wrench to operate workpieces of different sizes and specifications, thereby facilitating the user operating the ratchet wrench, and thereby enhancing the versatility of the ratchet wrench.

In accordance with the present invention, there is provided a ratchet wrench, comprising a handle, a ratchet wheel, a plurality of adjusting blocks, and an adjusting shaft, wherein:

- the ratchet wheel is mounted on the handle and has an inside formed with a working space, the ratchet wheel has a peripheral wall formed with a plurality of screw bores each communicating with the working space;
- each of the adjusting blocks is movably mounted in a respective one of the screw bores of the ratchet wheel and has a peripheral wall formed with an outer thread; and
- the adjusting shaft is rotatably mounted in the working space of the ratchet wheel and has a toothed disk meshing with the outer thread of each of the adjusting blocks, so that each of the adjusting blocks is rotated by rotation of the adjusting shaft to move in the respective screw bore of the ratchet wheel into the working space of the ratchet wheel so as to adjust a working size of the working space of the ratchet wheel.

Further benefits and advantages of the present invention will become apparent after a careful reading of the detailed description with appropriate reference to the accompanying drawings.

DETAILED DESCRIPTION OF THE INVENTION

Figure 1:
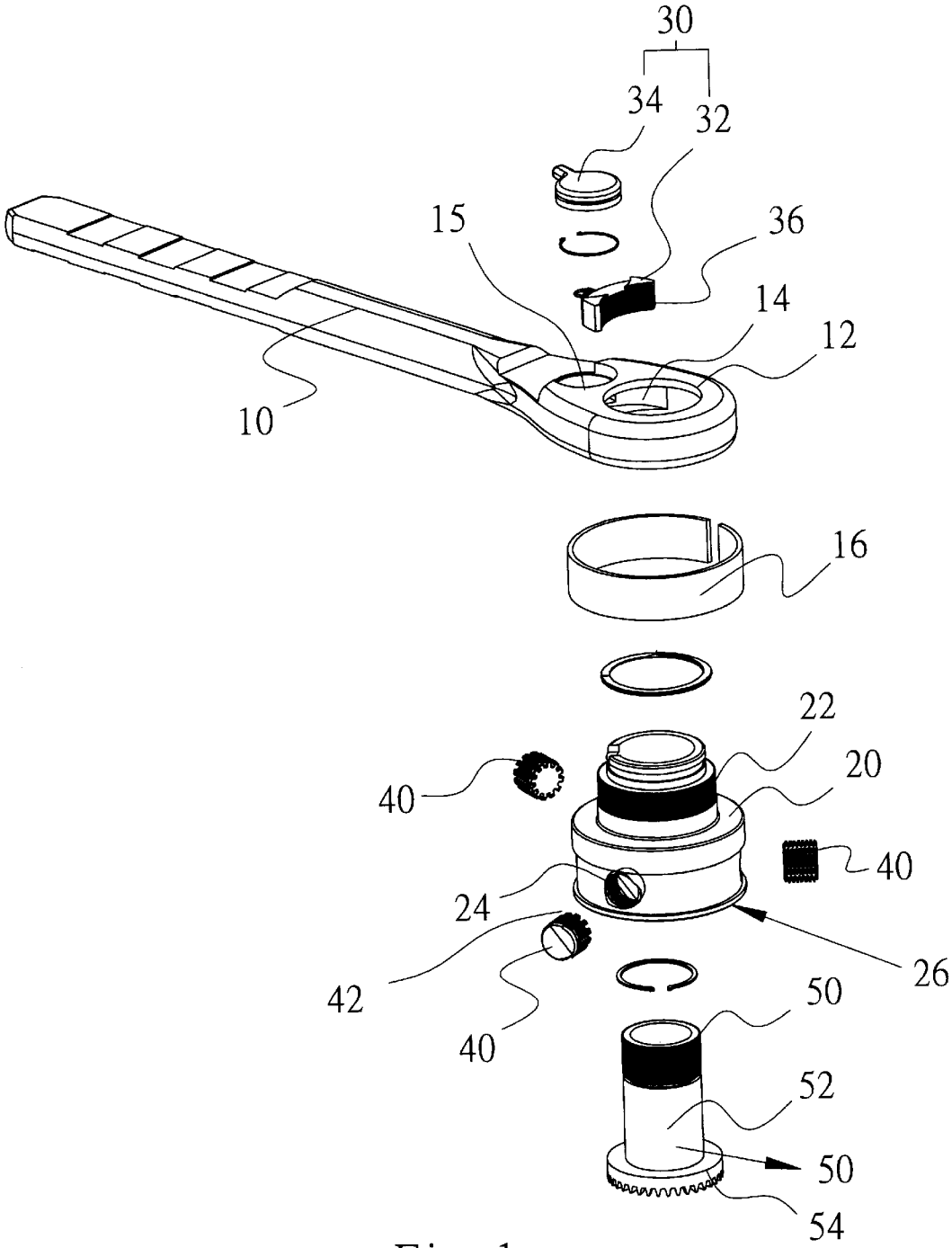
FIG. 1 is an exploded perspective view of a ratchet wrench in accordance with the preferred embodiment of the present invention.
Figure 2:
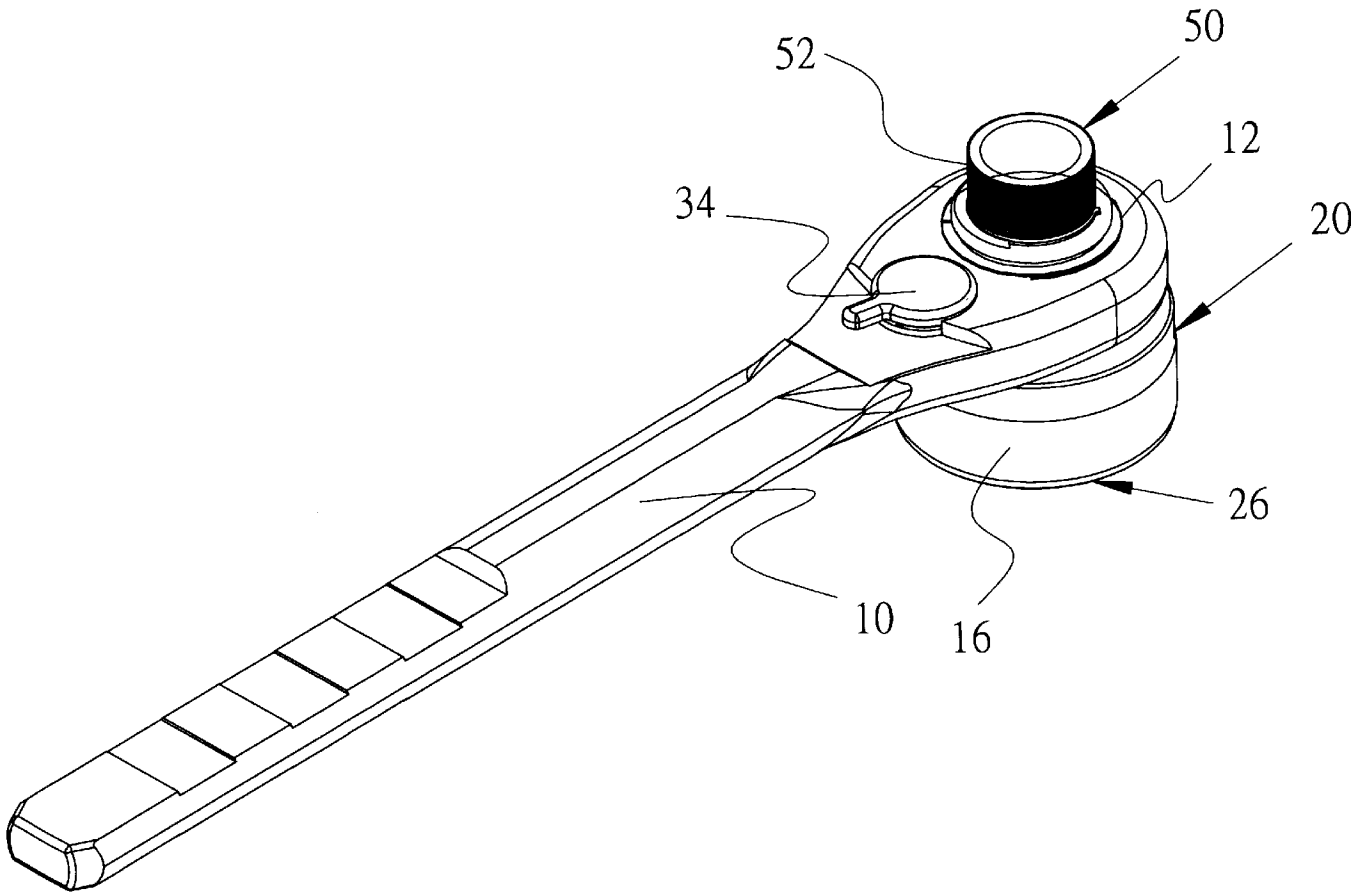
FIG. 2 is a perspective assembly view of the ratchet wrench in accordance with the preferred embodiment of the present invention.
Figure 3:
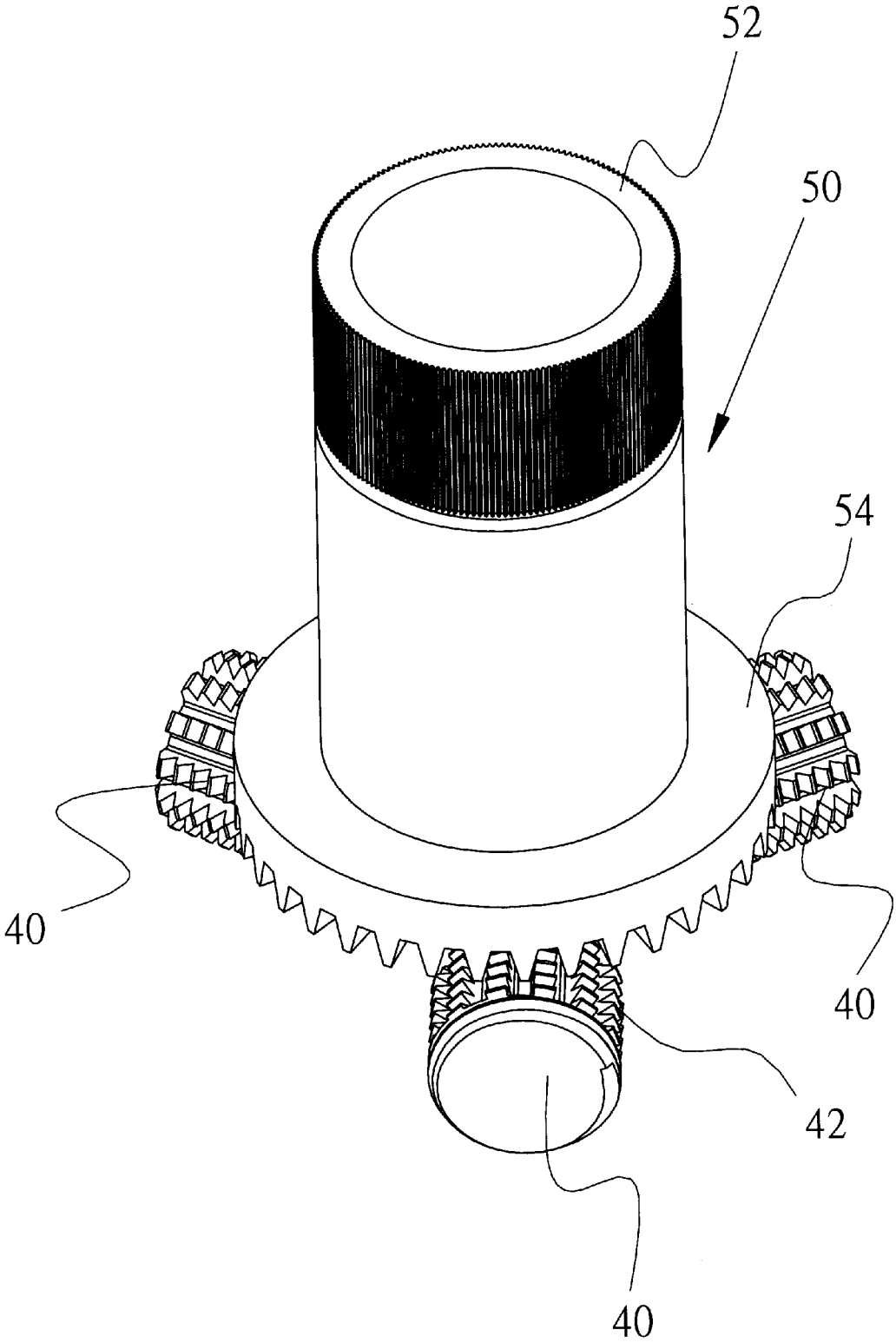
FIG. 3 is a partially perspective assembly view of the ratchet wrench in accordance with the preferred embodiment of the present invention.

Referring to the drawings and initially to FIGS. 1–3, a ratchet wrench with an adjustable working size in accordance with the preferred embodiment of the present invention comprises a handle 10, a direction control device 30, a ratchet wheel 20, a plurality of adjusting blocks 40, and an adjusting shaft 50.

The handle 10 has an end formed with a receiving hole 12 and a mounting hole 14 located beside and communicated with the receiving hole 12. The handle 10 is formed with a receiving recess 15 communicated with the mounting hole 14.

The direction control device 30 includes a pawl member 32 and a control knob 34. The pawl member 32 is mounted in the mounting hole 14 of the handle 10 and has a first side formed with a plurality of engaging teeth 36 directed toward the receiving hole 12 of the handle 10. The control knob 34 is mounted in the receiving recess 15 of the handle 10 and is connected to a second side of the pawl member 32 to drive the pawl member 32 to pivot.

The ratchet wheel 20 is mounted on the handle 10 and has a first end mounted in the receiving hole 12 of the handle 10 and formed with a plurality of ratchet teeth 22 meshing with the engaging teeth 36 of the pawl member 32. The ratchet wheel 20 has a second end protruded outward from the receiving hole 12 of the handle 10 and having an inside formed with a working space 26. The second end of the ratchet wheel 20 has a peripheral wall formed with a plurality of screw bores 24 each communicating with the working space 26.

Each of the adjusting blocks 40 is movably mounted in a respective one of the screw bores 24 of the ratchet wheel 20 and has a peripheral wall. formed with an outer thread 42. Each of the adjusting blocks 40 is extended into the working space 26 of the ratchet wheel 20.

The adjusting shaft 50 is rotatably mounted in the ratchet wheel 20 and has a first portion 52 extended outward from the first end of the ratchet wheel 20 and the receiving hole 12 of the handle 10. The adjusting shaft 50 has a second portion formed with an enlarged toothed disk 54 meshing with the outer thread 42 of each of the adjusting blocks 40.

Figure 4:
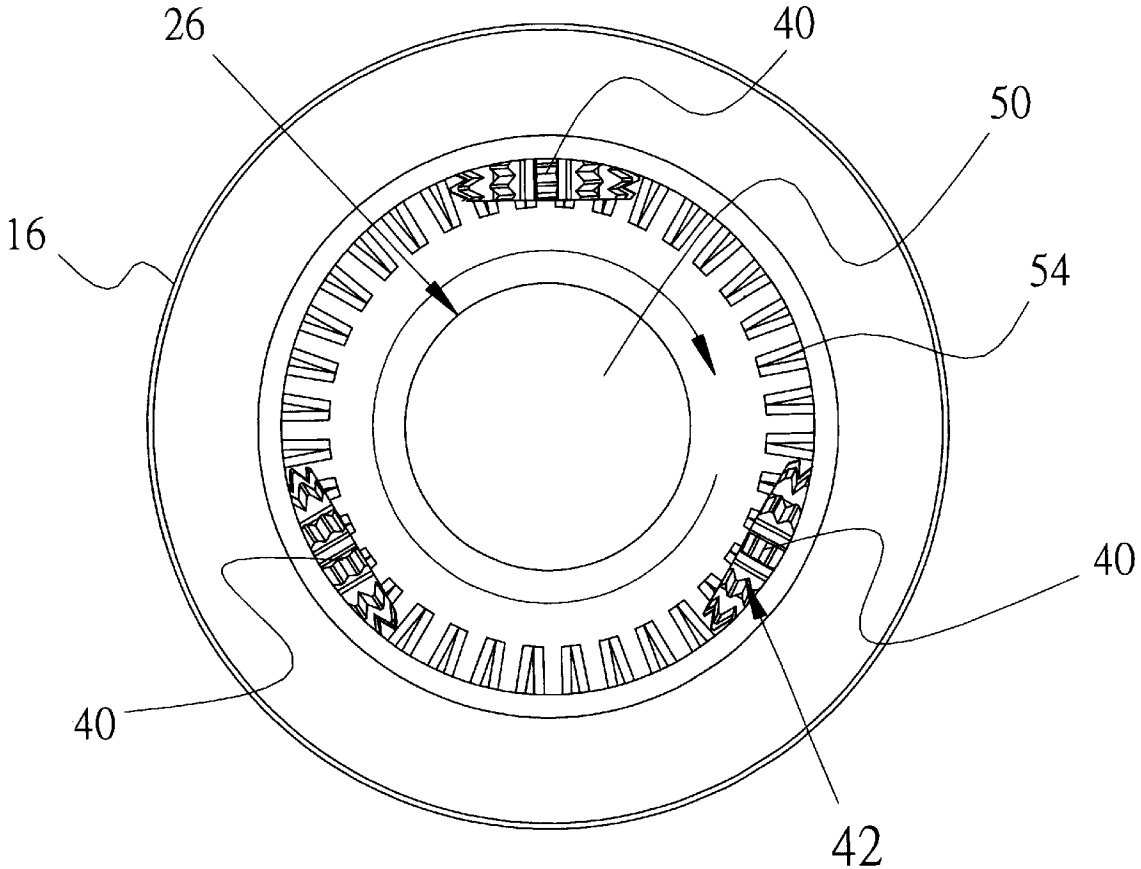
FIG. 4 is a top plan cross-sectional view showing adjustment of the ratchet wrench as shown in FIG. 2.
Figure 5:
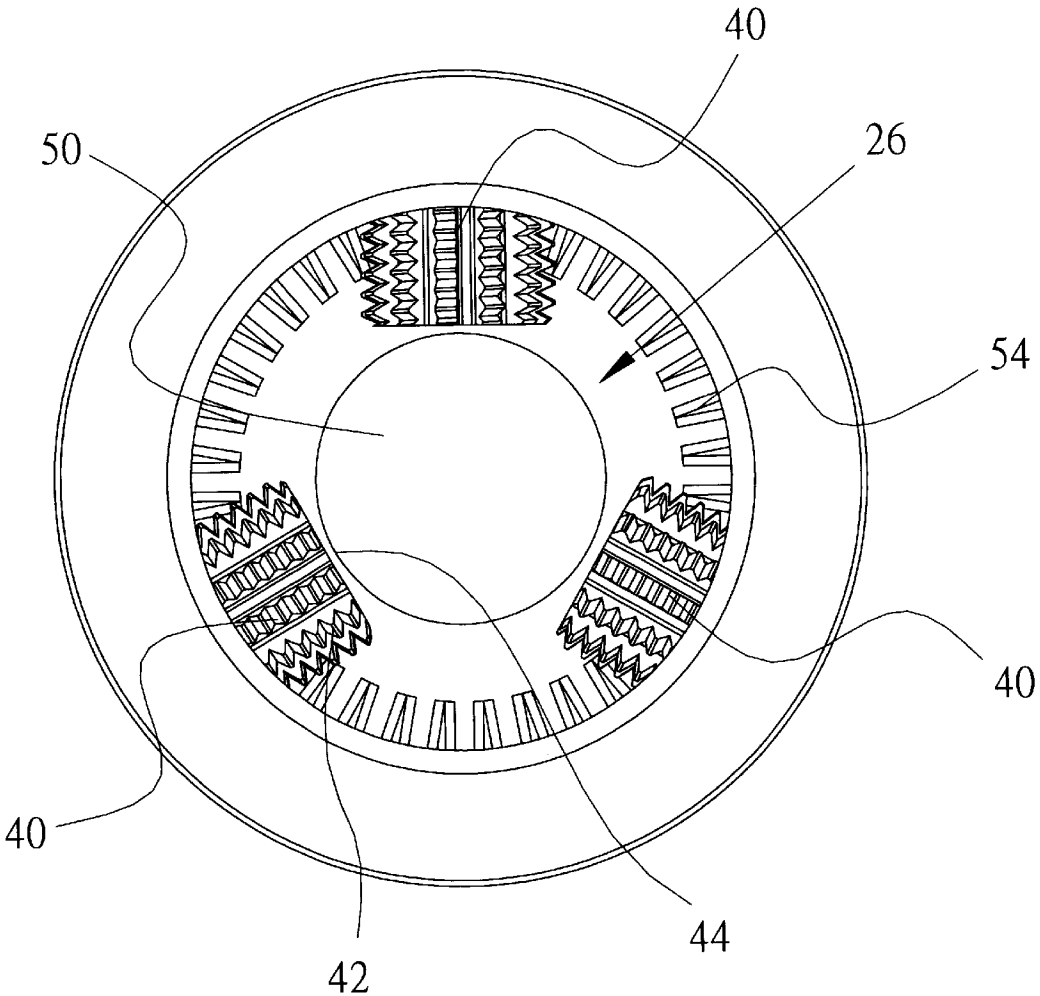
FIG. 5 is another top plan cross-sectional view showing adjustment of the ratchet wrench as shown in FIG. 2.

Referring to FIGS. 4 and 5 with reference to FIGS. 1–3, when the user wishes to adjust the size of the working space 26 of the ratchet wheel 20, the first portion 52 of the adjusting shaft 50 can be rotated by the user. At this time, the toothed disk 54 of the adjusting shaft 50 meshes with the outer thread 42 of each of the adjusting blocks 40, so that rotation of the adjusting shaft 50 can drive each of the adjusting blocks 40 to rotate in the respective screw bore 24 of the ratchet wheel 20. Thus, each of the adjusting blocks 40 can be rotated to extend into the working space 26 of the ratchet wheel 20 so as to shorten the working size of the working space 26 of the ratchet wheel 20, or to retract outward from the working space 26 of the ratchet wheel 20 so as to enlarge the working size of the working space 26 of the ratchet wheel 20.

Figure 6:
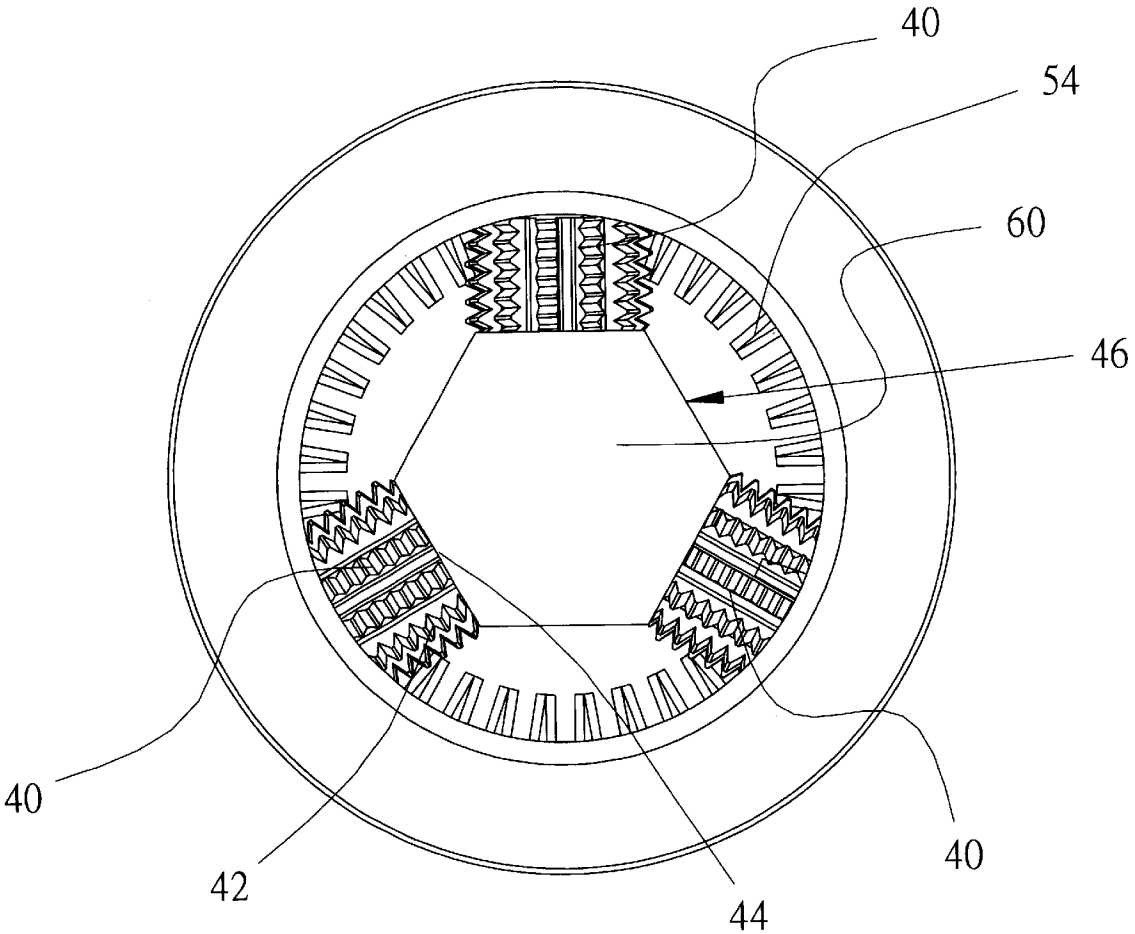
FIG. 6 is a top plan cross-sectional operational view of the ratchet wrench as shown in FIG. 2.

Referring to FIG. 6, the protruding ends 44 of the adjusting blocks 40 form a clamping chamber 46 in the working space 26 of the ratchet wheel 20 so as to clamp a workpiece 60, so that the workpiece 60 can be rotated by rotation of the handle 10. In such a manner, the size of the clamping chamber 46 formed by the protruding ends 44 of the adjusting blocks 40 can be adjusted arbitrarily and easily by rotation of the adjusting shaft 50, so that the ratchet wrench can be used to operate workpieces 60 of different sizes and specifications. Thus, the user only needs to use a single ratchet wrench to operate workpieces 60 of different sizes and specifications, thereby facilitating the user operating the ratchet wrench, and thereby enhancing the versatility of the ratchet wrench.

Referring to FIGS. 1, 2 and 4, the ratchet wrench further comprises a substantially C-shaped protective ring 16 mounted on the ratchet wheel 20 to stop and encompass the adjusting blocks 40, thereby preventing the adjusting blocks 40 from detaching from the screw bores 24 of the ratchet wheel 20 due to excessive rotation.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A ratchet wrench, comprising a handle, a ratchet wheel, a plurality of adjusting blocks, and an adjusting shaft, wherein:

the ratchet wheel is mounted on the handle and has an inside formed with a working space, the ratchet wheel has a peripheral wall formed with a plurality of screw bores each communicating with the working space;

each of the adjusting blocks is movably mounted in a respective one of the screw bores of the ratchet wheel and has a peripheral wall formed with an outer thread; and the adjusting shaft is rotatably mounted in the working space of the ratchet wheel and has a toothed disk meshing with the outer thread of each of the adjusting blocks, so that each of the adjusting blocks is rotated by rotation of the adjusting shaft to move in the respective screw bore of the ratchet wheel into the working space of the ratchet wheel so as to adjust a working size of the working space of the ratchet wheel.

2. The ratchet wrench in accordance with claim 1, wherein the adjusting shaft has a first portion extended outward from the ratchet wheel.

3. The ratchet wrench in accordance with claim 2, wherein the adjusting shaft has a second portion formed with the toothed disk.

4. The ratchet wrench in accordance with claim 1, wherein each of the adjusting blocks has a protruding end extended into the working space of the ratchet wheel.

5. The ratchet wrench in accordance with claim 1, further comprising a protective ring mounted on the ratchet wheel to stop and encompass the adjusting blocks, thereby preventing the adjusting blocks from detaching from the screw bores of the ratchet wheel due to excessive rotation.

6. The ratchet wrench in accordance with claim 4, wherein the protective ring is substantially C-shaped.

7. The ratchet wrench in accordance with claim 1, wherein the adjusting blocks have protruding ends forming a clamping chamber in the working space of the ratchet wheel so as to clamp a workpiece, so that the workpiece can be rotated by rotation of the handle.

8. The ratchet wrench in accordance with claim 7, wherein the clamping chamber formed by the protruding ends of the adjusting blocks can be adjusted by rotation of the adjusting shaft, so that the ratchet wrench can be used to operate workpieces of different sizes.

9. The ratchet wrench in accordance with claim 1, wherein the handle has an end formed with a receiving hole, and the ratchet wheel has a first end mounted in the receiving hole of the handle and formed with a plurality of ratchet teeth.

10. The ratchet wrench in accordance with claim 9, wherein the ratchet wheel has a second end protruded outward from the receiving hole of the handle and having an inside formed with the working space.

* * * * *